US005778917A

United States Patent [19]

Whitmore et al.

[11] Patent Number: 5,778,917

[45] Date of Patent: Jul. 14, 1998

[54] NATURAL GAS COMPRESSION HEATING PROCESS

[75] Inventors: Ward A. Whitmore, Anchorage, Ak.; Michael C. Metz, Clay Center, Kans.

[73] Assignee: Yukon Pacific Corporation, Anchorage, Ak.

[21] Appl. No.: 879,088

[22] Filed: Jun. 19, 1997

[51] Int. Cl.[6] ..... F17D 1/16

[52] U.S. Cl. ..... 137/13; 62/260; 165/45

[58] Field of Search ..... 137/13; 165/45; 62/260

[56] References Cited

U.S. PATENT DOCUMENTS

| | | | |
|---|---|---|---|
| 2,958,205 | 11/1960 | McConkey | 62/48.2 |
| 4,269,539 | 5/1981 | Hopke | 405/130 |
| 4,372,332 | 2/1983 | Mast | 137/1 |
| 4,563,203 | 1/1986 | Weiss et al. | 62/613 |
| 4,921,399 | 5/1990 | Lew | 415/27 |
| 5,372,010 | 12/1994 | Gratz | 62/87 |

*Primary Examiner*—Ronald C. Capossela
*Attorney, Agent, or Firm*—Richard C. Litman

[57] ABSTRACT

A natural gas compression heating process for regulating the operating temperature of the natural gas flowing through long pipelines in continuous permafrost and discontinuous permafrost regions. The heat obtained through compression of the natural gas, instead of actually heating as performed conventionally, is utilized to raise the temperature of the natural gas to only the desired operating temperature. Consequently, the locations of the natural gas compression heating process and compression stations along the pipeline in a permafrost region are determined by the flowing temperature profile of the pipeline instead of the conventional standard compression cost versus pipeline diameter analysis.

13 Claims, 2 Drawing Sheets

NATURAL GAS COMPRESSION HEATING PROCESS

BACKGROUND OF THE INVENTION

1. Field of the Invention

The present invention relates to a process for regulating the operating temperature and pressure of the natural gas flowing through long pipelines buried in continuous permafrost and discontinuous permafrost regions. Heat obtained through compression of the natural gas instead of heating the gas conventionally is utilized to raise the temperature of the natural gas to a desired operating temperature. The pressure of the natural gas is also raised thereby increasing the efficiency of gas flow through the pipeline and extending the distance between compressor stations which require cooling of the gas after compression. Consequently, the locations of the compression heaters and compression stations along the pipeline in a continuous permafrost or discontinuous permafrost region are determined by the flowing temperature profile of the pipeline instead of the conventional standard compression cost versus pipeline diameter analysis.

2. Description of the Related Art

A continuous permafrost region is defined as a geographic region where the ground is everywhere permanently frozen. A discontinuous permafrost region is defined as a geographic region where permafrost occurs in some areas whereas other areas are free of permafrost.

Design considerations for pipelines operating in the "cold mode" at subzero degree Celsius (below 32° F.) temperatures differ from pipelines operating in the "warm mode", i.e., above the freezing temperature. Operation in the cold mode allows the burial of the pipeline in permafrost regions without thawing the soils and subsequently losing support of the pipeline. However, very cold operation of pipelines in continuous permafrost may result in redistribution of moisture below the pipeline causing upward movement. Operation in the cold mode also allows burial of the pipeline in discontinuous permafrost regions, but the stress on the pipeline due to differential heaving of the soils must be considered. In the warm mode, consideration must be given to nonuniform thaw and consequent settlement of the pipeline. Thus, temperature control of the pipeline is a critical design parameter regardless of whether the pipeline is operating in a cold or warm mode and regardless of whether the pipeline is buried in continuous permafrost or discontinuous permafrost.

It is known that friction of the flowing gas in a pipeline causes a decrease in operating pressure with an associated decrease in operating temperature in accordance with the Joule-Thompson coefficient of the gas. It is also known that Joule-Thompson cooling of natural gas is less at higher pipeline operating pressures. The operating temperature of the pipeline is a function of the pressure decline through the pipeline, the associated JouleThompson cooling of the gas, and heat transfer through the pipe wall.

The related art of interest describes various methods and apparatus for maintaining the desired temperature of natural gas in a pipeline in permafrost regions. Each reference requires one or more cooling steps after the compression step, whereas the present invention precludes any cooling step after compression of the natural gas. The art of interest will be discussed in the order of their perceived relevance to the present invention.

U.S. Pat. No. 5,372,010 issued on Dec. 13, 1994, to Gunther Gratz describes a method and arrangement for the compression of gas in a compressor station for a gas pipeline located in permafrost areas. The incoming gas at 15° C. and 50 bar is compressed to 75–100 bar to increase the temperature to 600° to 80° C. and pressure, but cooled first to 25° C. and decreased in pressure 2 bar by heat exchange. The gas is again compressed to 80° C. and cooled by heat exchange to 25° C. The pressure of the gas is decreased by expansion turbines to the pipeline pressure of 75 bar and a temperature of minus 5° to 0° C. before the gas is returned to the pipeline. The fuel for operating the gas turbines for compression comes from the supply line. The present invention differs from this conventional process since the discharge temperature and pressure are regulated to achieve the desired gas temperature for reentry into the pipeline; thus, the costly cooling step is not required.

U.S. Pat. No. 4,372,332 issued on Feb. 8, 1983, to Burton T. Mast describes a compressor station and a process for operation on the flowing gas in an arctic gas pipeline to reduce the temperature to less than freezing. The pipeline gas is preheated by recycled heated gas, compressed and cooled to above freezing temperature with heat exchange by ambient air and the pipeline gas. If further cooling is required, the gas is expanded before discharging the gas to the pipeline. The process still mandates two cooling steps which are not required by the present inventive process.

U.S. Pat. No. 4,921,399 issued on May 1, 1990, to Lawrence E. Lew describes a gas pipeline temperature control method and apparatus. The pipeline gas at 27°° F. and 800 p.s.i. is compressed to about 2,000 p.s.i., a portion of the heated gas is cooled, and then a division of the cooled gas stream is controlled to supply both a cooled recycle stream for anti-surge control and a cooled stream for mixing with the warm compressed gas for temperature control. Again, several cooling steps are employed necessitating more equipment which adds to the cost of compressing the gas.

U.S. Pat. No. 4,563,203 issued on Jan. 7, 1986, to Irving Weiss et al. describes a refrigeration process from the expansion of transmission pipeline gas by adding methanol to pipeline gas at 400 to 1000 p.s.i.a. to obtain a lower pressure of 200 to 450 p.s.i.a. and a temperature above minus 100° F., separating the aqueous methanol, and compressing the gas for delivery to the pipeline. The present invention does not require recovery of refrigeration from the expanded gas, or the addition of methanol.

U.S. Pat. No. 4,269,539 issued on May 26, 1981, to Scott W. Hopke describes a method for a buried pipeline system for preventing damage to a refrigerated gas pipeline due to excessive frost heaving by heat pipes. This reference is cited merely as art of interest to show the problem of buried pipelines in permafrost soil.

None of the above inventions and patents, taken either singularly or in combination, is seen to describe the instant invention as claimed. Thus, a natural gas compression heating process solving the aforementioned problems without one or more cooling steps by external heat exchange is desired.

SUMMARY OF THE INVENTION

Accordingly, it is a principal object of the invention to provide a process for regulating the temperature of the natural gas passing through a pipeline operating in a cold or warm mode, and which is buried in continuous permafrost or discontinuous permafrost regions without one or more cooling steps after compression.

It is an object of the invention to obtain heat through compression of the natural gas to effect a temperature increase in the gas.

It is another object of the invention to provide a process for raising the temperature of the natural gas in a pipeline without external heating employing a fired or indirectly fired heater.

It is a further object of the invention to provide a process for raising the operating pressure of a pipeline operating in continuous permafrost or discontinuous permafrost regions.

It is an additional object of the invention to provide a process to increase the flow efficiency of gas flow in a pipeline by raising the pipeline operating pressure.

Another object of the invention is to provide a process to reduce the Joule-Thompson coefficient of a flowing gas by raising the operating pressure of the gas within a pipeline.

Yet a further object of the invention is to provide a process for reducing cooling of a gas in downstream segments of a pipeline by increasing the pipeline flow efficiency and reducing the JouleThompson coefficient of the gas.

Still another object of the invention is to extend the distance between compressor stations in a pipeline, which require one or more steps to cool the discharge gas by external heat exchange.

It is an object of the invention to provide improved elements and arrangements thereof in a natural gas compression heating process for the purposes described which is less expensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention provides a method for processing natural gas in a pipeline laid in either continuous permafrost or discontinuous permafrost regions for continued passage in the pipeline with sufficient temperature and pressure, and without the conventional implementation of either heating alone or one or more cooling steps after a compression step. The inventive method permits the regulation of gas temperatures flowing through pipelines which are operating in the cold mode as well as in the warm mode. The inventive method is applicable to both low and high pressure pipelines.

The trend has been to increase the operating pressures in gas pipelines in order to allow the gas to be transported within the pipeline in the dense phase. The dense phase refers to a condition in which distinct gas and liquid phases cannot coexist at pipeline operating conditions. The composition of the gas transported in the dense phase allows inclusion of compounds in the gas which otherwise would form a liquid phase if transported in a pipeline operating at lower pressures. Compounds which can be included in gas transported in the dense phase are methane, ethane, propane, butane, gasoline, and various grades of fuel oils. Operation of a pipeline at increased pressures has the added benefit of reducing the Joule-Thompson cooling effect in the pipeline gas.

It is known that the use of fired heaters to achieve an increase in the pipeline operating temperature does not increase operating pressure and flow efficiency in the pipeline.

Figure 1:
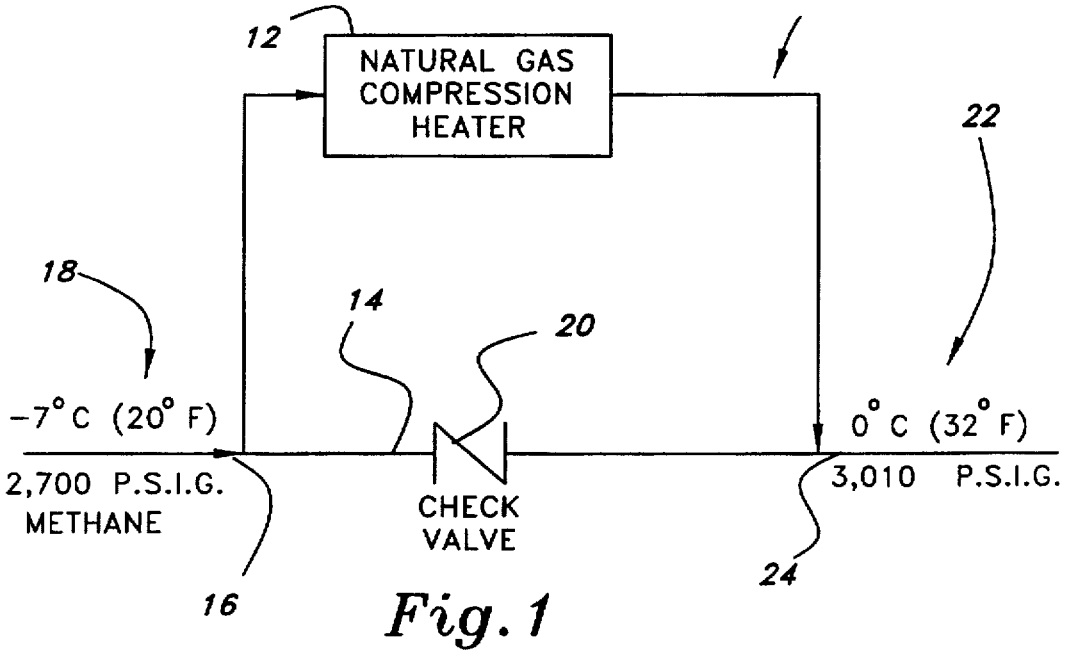
FIG. 1 is a schematic view of a natural gas compression heating process with exemplary entry and exit temperatures and pressures of the natural gas (methane is assumed for illustration purposes) according to the present invention.

FIG. 1 depicts the present inventive process 10, wherein a representative compression heater(s) 12 in a station is positioned along a natural gas pipeline 14. The entry gas 16, considered methane for this example, enters the example with parameters 18 at a temperature of minus 70° C. or 20° F. and a line pressure of 2,700 p.s.i.g. When the compression heater(s) 12 is(are) employed to elevate the temperature and pressure to predetermined values, flow through the check valve 20 stops, and the gas 16 flows through the suction to the heater(s) 12.

The monitoring of the pressure and temperatures around the natural gas compression heater is accomplished using both the control system local to the compression heater as well as the control system governing operation of the entire pipeline system. The natural gas compression heater(s) 12 in the station consequently compresses the gas to the desired exit parameters 22 of, for this example, a temperature of 0° C. (32° F .) and a corresponding pressure of 3,010 p.s.i.g. and returns the treated gas to the pipeline 14 as exit gas 24. The compression process 10 is constantly monitored by the local and central control systems to regulate operation of the compression heater to maintain the process parameters 22 of the exit gas 24. The heaters 12 can be arranged in series or in parallel to accomplish the desired end parameters of the effluent gas. The driving energy for the compression heater (s) 12 can be obtained from various sources including a portion of the flowing entry gas 16 to drive gas turbines (not shown).

Figure 2:
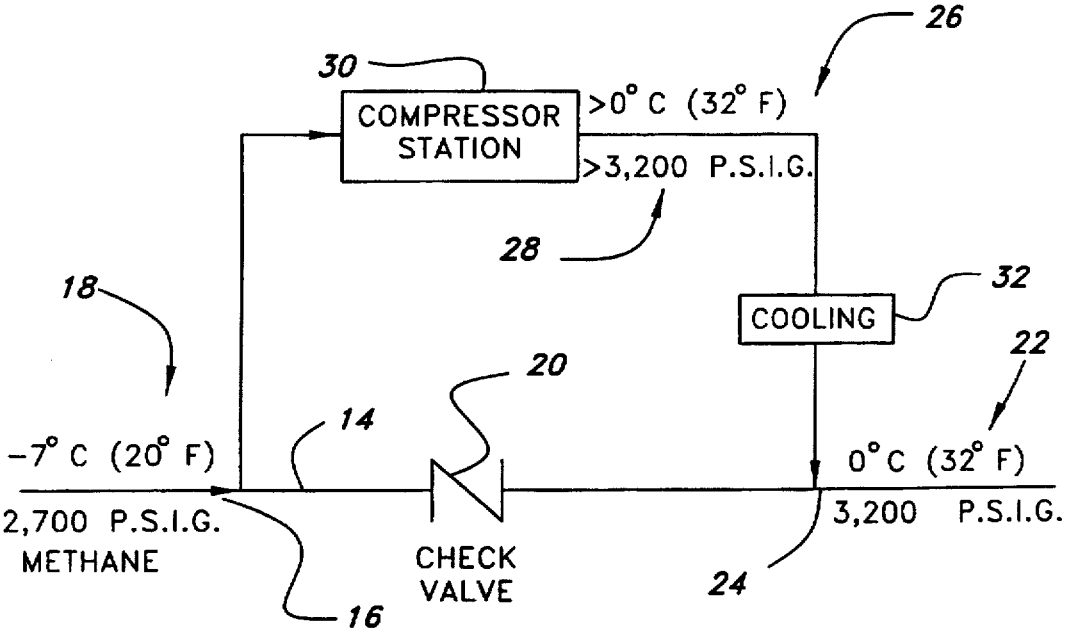
Fig. 2 (PRIOR ART)
FIG. 2 is a schematic view of a prior art process utilizing compressor station(s) in a natural gas line with exemplary entry and exit temperatures and pressures.

FIG. 2 illustrates a prior art compressing to a predetermined pressure and mandatory cooling process 26 schematically with the same inlet parameters 18, but having different elevated outlet gas parameters 28 issuing from the compressor station 30 at process parameters of a temperature greater than 0° C. (32° F.) and a pressure greater than 3,200 p.s.i.g. which must be reduced by one or more cooling steps 32. A slight pressure drop is typically encountered as the gas passes through the cooling steps 32. The gas exiting process 26 and reentering the pipeline 24 is at the same temperature as the gas exiting the compression heater and reentering the pipeline 24. The pressure of the gas exiting the compression heater 10 (3,010 p.s.i.g.) in this example is less than the pressure of the gas leaving the cooling 32 (3,200 p.s.i.g.) portion of compressor station 30. Use of the compression heater effects the desired increase in operating temperature of the gas pipeline and, in this example, achieves approximately three-fifths of the allowable increase in operating pressure which can be obtained without exceeding the maximum allowable working pressure of the pipeline which, in this example, is 3,200 p.s.i.g..

Figure 3:
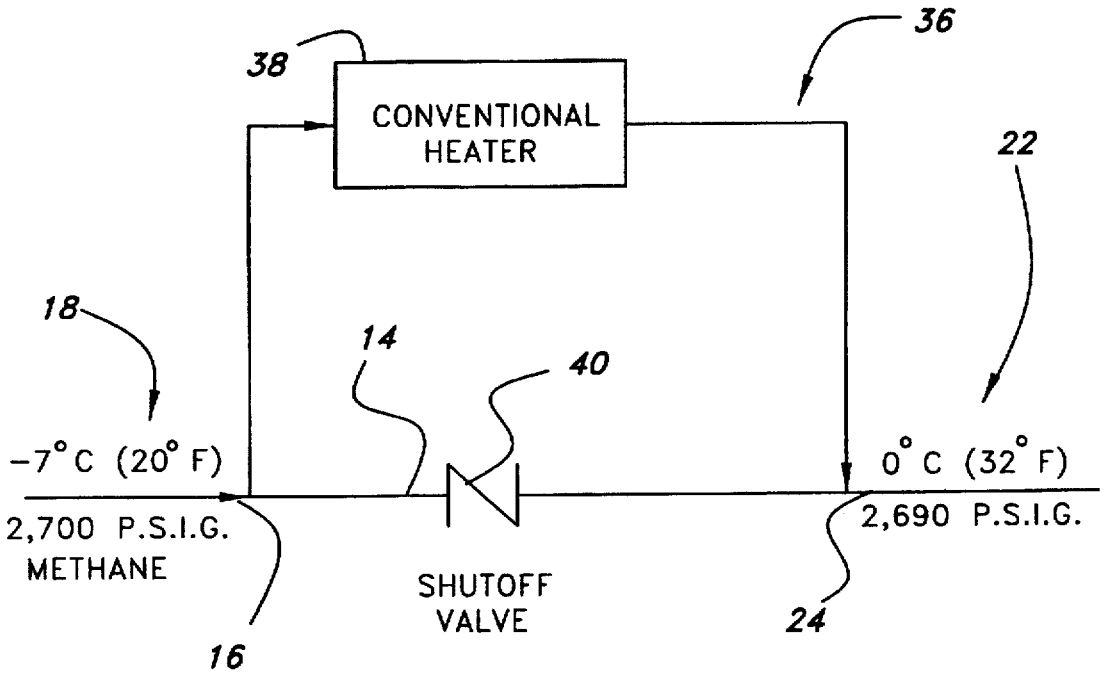
Fig. 3 (PRIOR ART)
FIG. 3 is a schematic view of a prior art process utilizing a conventional fired heater in a natural gas line with exemplary entry and exit temperatures and pressures.

FIG. 3 illustrates a prior art heating of the natural gas using a conventional heater process 36 with the same inlet parameters 18, but having different outlet parameters 22 issuing from the conventional heater 38 of a temperature of 0° C. (32° F.) and a pressure of 2,690 p.s.i.g. for the gas reentering the pipeline 24. The conventional heater 36 effects an increase in gas temperature, but results in a decrease in gas pressure reentering the pipeline due to pressure decline through the conventional heater. The shut-off valve 40 must be closed to direct gas through the conventional heater 38. The gas exiting process 36 is at the same temperature as the gas exiting the compression heater 10 and reentering the pipeline 24. The pressure of the gas exiting the compression heater 10 (3,010 p.s.i.g.) in this example is greater than the pressure of the gas leaving the conventional heater process 36 (2,690 p.s.i.g.).

Although at first glance the present invention appears to be a simplification of a known process, the omission of conventional process steps of cooling and application of the compression heating principle is an advance in the art of controlling the gasline temperature and pressure and should be considered of no small measure indeed. The invention achieves the desired increase in pipeline operating temperature without the capital and operating expenses of cooling 32 which is a mandatory process associated with the compressor station 30. The invention achieves the desired increase in pipeline operating temperature as achievable with a conventional heater, but with the incremental benefits associated with increasing pipeline operating pressure.

It will be readily apparent to those skilled in the art that relatively higher and lower operating pressures and/or temperatures are encompassed within the scope of the invention. For example, a pipeline directed through non-permafrost soils could have gas flowing therethrough at operating temperatures of 40° F. or more.

It is to be understood that the present invention is not limited to the embodiment described above, but encompasses any and all embodiments within the scope of the following claims.

We claim:

1. A natural gas compression heating process for heating and simultaneously pressurizing a natural gas and devoid of a cooling step to treat the gas passing through a pipeline located in a continuous permafrost or discontinuous permafrost region comprising:

providing at least one natural gas compression heater positioned along a natural gas pipeline located in a permafrost or discontinuous permafrost region;

diverting a natural gas passing through said pipeline as an entry gas having a predetermined temperature and pressure below a desired standard;

controlling the heating and simultaneous pressurizing of the diverted entry gas with the at least one compression heater to a higher predetermined and desired temperature and corresponding pressure as an exit gas suitable for continued passage in the pipeline;

said compression heating step being devoid of any subsequent cooling step for cooling the compressed and heated gas; and returning the pressurized and heated exit gas to the natural gas pipeline.

2. The process according to claim 1, wherein the simultaneous controlling of the heating and pressuring of the entry gas is controlled automatically.

3. The process according to claim 1, wherein the temperature and pressure of the entry gas is monitored.

4. The process according to claim 1, wherein the temperature and pressure of the exit gas is monitored.

5. The process according to claim 1, wherein the temperature and pressure of the entry gas and the exit gas is monitored.

6. The process according to claim 1, wherein the temperatures and pressures of the entry gas and the exit gas are monitored for control of the exit gas from the compression heating step.

7. The process according to claim 1, wherein the pipeline is operated in a cold mode.

8. The process according to claim 1, wherein the pipeline is operated in a warm mode.

9. The process according to claim 1, wherein the process is employed repeatedly along a natural gas pipeline to effect a desired temperature and pressure control of the natural gas pipeline.

10. The process according to claim 1, wherein the process is employed sequentially with compressor stations, which employ cooling of gas prior to reentering the natural gas pipeline, as required to effect the desired, predetermined flowing temperature and pressure control of the natural gas pipeline.

11. The process according to claim 1, wherein the process is employed intermittently with compressor stations, which employ cooling of gas prior to reentering the natural gas pipeline, as required to effect the desired, predetermined flowing temperature and pressure control of the natural gas pipeline.

12. The process according to claim 1, wherein the process is employed selectively sequentially and intermittently with compressor stations, which employ cooling of gas prior to reentering the natural gas pipeline, as required to effect the desired, predetermined flowing temperature and pressure control of the natural gas pipeline.

13. The process according to claim 1, wherein the locations of the compression heater stations along a natural gas pipeline are determined by a flowing temperature profile of the pipeline through a permafrost region.

* * * * *